US005545880A

United States Patent [19]

Bu et al.

[11] Patent Number: 5,545,880

[45] Date of Patent: Aug. 13, 1996

[54] METHOD FOR AUTOMATIC CONTROL OF A MICROWAVE OVEN

[75] Inventors: Jong Uk Bu, Seoul; Tae Yun Kim, Kyungki-do, both of Rep. of Korea

[73] Assignee: Goldstar Co., Ltd., Rep. of Korea

[21] Appl. No.: 407,197

[22] Filed: Mar. 20, 1995

[51] Int. Cl.[6] ..... H05B 6/68

[52] U.S. Cl. ..... 219/703; 219/710; 219/719; 99/325

[58] Field of Search ..... 219/703, 710, 219/711, 712, 713, 719; 99/DIG. 14, 325

[56] References Cited

U.S. PATENT DOCUMENTS

| | | | |
|---|---|---|---|
| 4,401,884 | 8/1983 | Kusunoki et al. | 219/492 |
| 4,751,356 | 6/1988 | Fukuda et al. | 219/10.55 B |
| 4,871,891 | 10/1989 | Steers et al. | 219/710 |
| 4,874,914 | 10/1989 | Eke | 219/703 |
| 5,155,339 | 10/1992 | An | 219/710 |
| 5,235,148 | 8/1993 | Yamaguchi et al. | 219/10.55 B |
| 5,281,786 | 1/1994 | Park | 219/10.55 M |
| 5,319,171 | 6/1994 | Tazawa | 219/703 |

*Primary Examiner*—Philip H. Leung
*Attorney, Agent, or Firm*—Faegre & Benson

[57] ABSTRACT

This invention relates to a method for automatic control of a microwave oven which can make precise cooking control available by classifying the cooking control into cases when cooking is completed below the boiling point of water, such as thawing or warming up, and cases when cooking is completed above the boiling point of water. For types of cooking which are complete without water boiling, the invention sets the initial cooking time period by determining the time it takes for the output voltage of a temperature detection sensor to reach a rise starting point. For types of cooking which include water boiling, the invention sets the initial cooking time period by determining the time it takes for the output voltage of the temperature detection sensor to reach a maximum rise point. The invention then sets an additional time period equivalent to the initial time period multiplied by a cooking constant corresponding to the type of cooking that is desired.

5 Claims, 4 Drawing Sheets

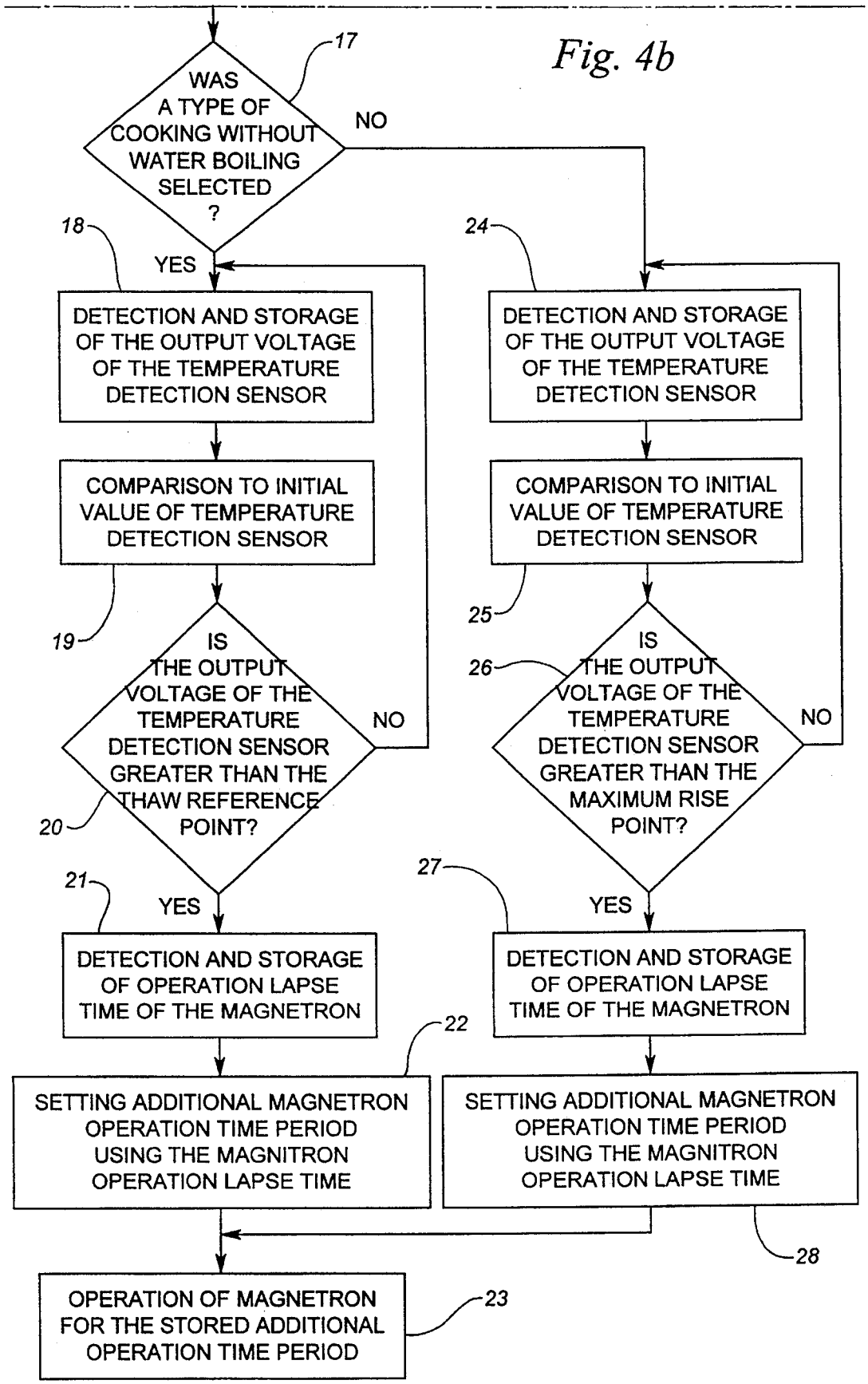
Fig. 4b
17
WAS A TYPE OF COOKING WITHOUT WATER BOILING SELECTED ?
NO
YES
18
DETECTION AND STORAGE OF THE OUTPUT VOLTAGE OF THE TEMPERATURE DETECTION SENSOR
COMPARISON TO INITIAL VALUE OF TEMPERATURE DETECTION SENSOR
19
IS THE OUTPUT VOLTAGE OF THE TEMPERATURE DETECTION SENSOR GREATER THAN THE THAW REFERENCE POINT?
NO
20
YES
21
DETECTION AND STORAGE OF OPERATION LAPSE TIME OF THE MAGNETRON
22
SETTING ADDITIONAL MAGNETRON OPERATION TIME PERIOD USING THE MAGNITRON OPERATION LAPSE TIME
24
DETECTION AND STORAGE OF THE OUTPUT VOLTAGE OF THE TEMPERATURE DETECTION SENSOR
COMPARISON TO INITIAL VALUE OF TEMPERATURE DETECTION SENSOR
25
26
IS THE OUTPUT VOLTAGE OF THE TEMPERATURE DETECTION SENSOR GREATER THAN THE MAXIMUM RISE POINT?
NO
27
YES
DETECTION AND STORAGE OF OPERATION LAPSE TIME OF THE MAGNETRON
SETTING ADDITIONAL MAGNETRON OPERATION TIME PERIOD USING THE MAGNITRON OPERATION LAPSE TIME
28
OPERATION OF MAGNETRON FOR THE STORED ADDITIONAL OPERATION TIME PERIOD
23

METHOD FOR AUTOMATIC CONTROL OF A MICROWAVE OVEN

FIELD OF THE INVENTION

This invention relates to a method for automatic control of a microwave oven, more particularly to a method which makes precise cooking control available by classifying cooking control into cases when cooking is completed below the boiling point of water, such as thawing and warming up, and cases when cooking is completed above the boiling point of water.

BACKGROUND OF THE INVENTION

Technology for automatic microwave oven cooking has generally been developed with an eye towards operational simplification and enhancement of consumer convenience. Various types of sensors have been used in prior art microwave ovens which have automatic cooking functions.

For example, prior art microwave ovens have used sensors located in the heating chamber for detecting temperature, sensors for detecting humidity, sensors for detecting gases generated during cooking, sensors for detecting vapor, and sensors for detecting the weight of food. There are many known methods for controlling cooking by utilizing the output signal of these types of sensors.

Even though many prior art sensors have been used for controlling various types of cooking, none of these methods has been adequate for controlling cooking with weak heat. When cooking with weak heat, which is commonly done, for example, when warming up food or thawing meat or fish, control should be based on the quantity of moisture generated throughout entire cooking period, i.e., humidity. Since it is difficult to detect humidity during warming up or thawing, controlling these types of cooking has been problematic.

Furthermore, when using a single container to successively thaw multiple pieces of meat or fish, prior art ovens that employ a humidity sensor often malfunction due to vapor being generated by the premature boiling of residual water that is left over from the previous thawing operation. As these vapors are not indicative of the current thawing process, they falsely indicate the status of the current thawing process. In order to reduce the frequency of this problem, manufacturers have attempted to explain in owners' manuals the necessity of fully cleaning and drying a container before using that container to thaw a new piece of food. Such efforts, however, may have the undesirable side effect of making microwave thawing cumbersome and inconvenient.

There are many prior art control algorithms which use the foregoing types of sensors. A cooking period control algorithm is one such prior art method which uses humidity sensors or gas sensors. FIG. 1 shows the typical output voltage over time of such gas sensors or humidity sensors during cooking. There is a sharp increase in the output of the sensors when water in the food starts to boil. This is due to generation of vapor or gas as the food is cooked.

One approach to controlling cooking in a microwave oven is to calculate the total amount of heat required to heat the food in the oven. The oven is then operated until this amount of heat has been generated and applied to the food. The total heat can be expressed in following equation:

$$Q=M\times C\times(t_f-t_i)+(M\times B) \qquad \text{equation 1,}$$

where Q is the total heat required to heat the food in a microwave oven to an appropriate state, C is the specific heat of the food, M is the quantity of food, $t_f$ is the boiling temperature of moisture in the food, $t_i$ is initial temperature of the food, and B is heat proportional to latent heat and degradation of food.

Because the total heat Q will be the same as the total heat generated by the microwave oven, the total heat Q can also be expressed as follows:

$$Q=T\times P \qquad \text{equation 2,}$$

where T is the total time period of cooking and P is the power output of the microwave oven.

Therefore, the following equation can be obtained by combining equations 1 and 2:

$$T=(M\times C\times(t_f-t_i))/P+(M\times B)/P \qquad \text{equation 3.}$$

As the first term of equation 1 represents the period of time from the start of cooking through the boiling of moisture in the food, and the second term represents the period of time from the start of vaporization of the moisture through the completion of cooking, the total period of cooking T can be expressed as follows;

$$T=T_1+K\times T_1 \qquad \text{equation 4,}$$

wherein, $$T_1=(M\times C\times(t_f-t_i))/P,$$

$$K=B/(C\times(t_f-t_i)),$$

and

K is a cooking constant which depends on the kind of cooking that is desired.

Thus, by using an appropriate cooking constant K, automatic cooking control can be achieved by an operator simply pressing control buttons on the microwave oven to indicate the desired type of cooking. This is so because $T_1$ can be readily determined, as follows. A reference detection point is set based on when the food starts to boil, namely when the output signal of the sensor rises sharply. The reference detection period $T_1$ will then be the time period from the start of cooking until the output of the sensor reaches reference detection point.

According to equation 4, the microwave oven should be operated for a first time period $T_1$ and then for an additional time period equivalent to $K\times T_1$, i.e., the length of time obtained by multiplying the time period $T_1$ by the cooking constant K. Thus, the total operational time period of the microwave oven will be the reference detection period $T_1$ added to the product of the reference detection period $T_1$ multiplied by the cooking constant K. The foregoing is an example of a prior art method used to control general microwave cooking by incorporating prior art humidity sensors, temperature sensors and gas sensors.

As cooking frozen food in microwave ovens becomes more frequent in modern society, the importance of the thawing function in microwave ovens increases. In situations where cooking should be completed prior to water boiling, for instance warming up or thawing food, the aforementioned automatic cooking control method, which relies on the boiling point of water to determine the reference detection point and the period $T_1$, cannot be used because water should not boil during this type of heating.

SUMMARY OF THE INVENTION

The object of this invention is to provide a method for automatic cooking control of a microwave oven which makes precise cooking control available for various types of cooking, including warming up and thawing. By using a sensor that can detect radiation heat generated during the cooking of food without any supplementary sensors, a microwave oven according to this invention can use a reference detection point below the boiling point of water to provide automatic cooking control.

These and other objects and features of this invention can be achieved by providing a method for automatic control of a microwave oven which includes the steps of: storing cooking constants for various types of cooking; initializing the microwave oven, including initializing a cooking time period monitoring timer; storing an initial value of a temperature detection sensor; setting a cooking constant corresponding to the type of cooking selected by a user; operating a magnetron and starting a cooking time period monitoring timer; identifying whether a desired cooking course includes water boiling; setting an additional magnetron operation time period for a cooking course with no water boiling based on a combination of the time period which it takes for the output voltage of the temperature detection sensor to reach a thaw reference point and a predetermined cooking constant; setting an additional magnetron operation time period for a cooking course with water boiling based on a combination of the time period which it takes for the output voltage of the temperature detection sensor to reach a maximum rise point; and operating the magnetron for the additional magnetron operation time period.

DETAILED DESCRIPTION OF THE PREFERRED EMBODIMENT

Figure 1:
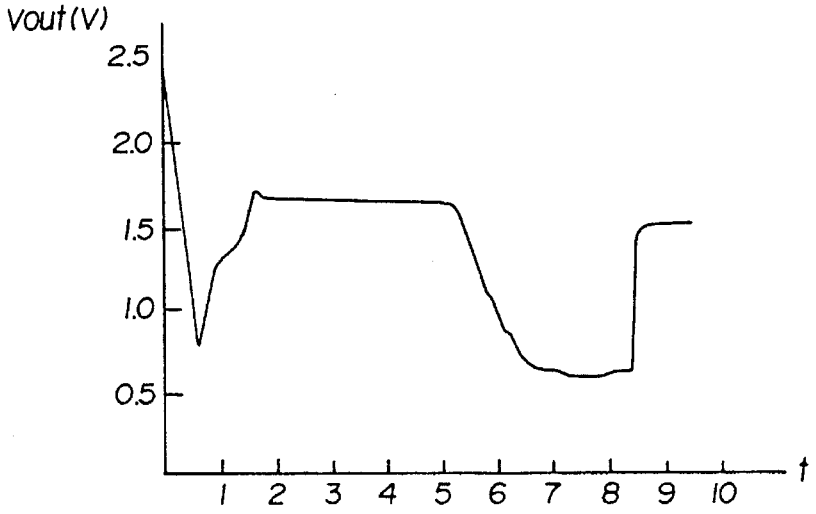
Fig. 1 PRIOR ART
FIG. 1 is a sample wave pattern of the output voltage of a sensor of a prior art microwave oven taken while cooking.
Figure 2:
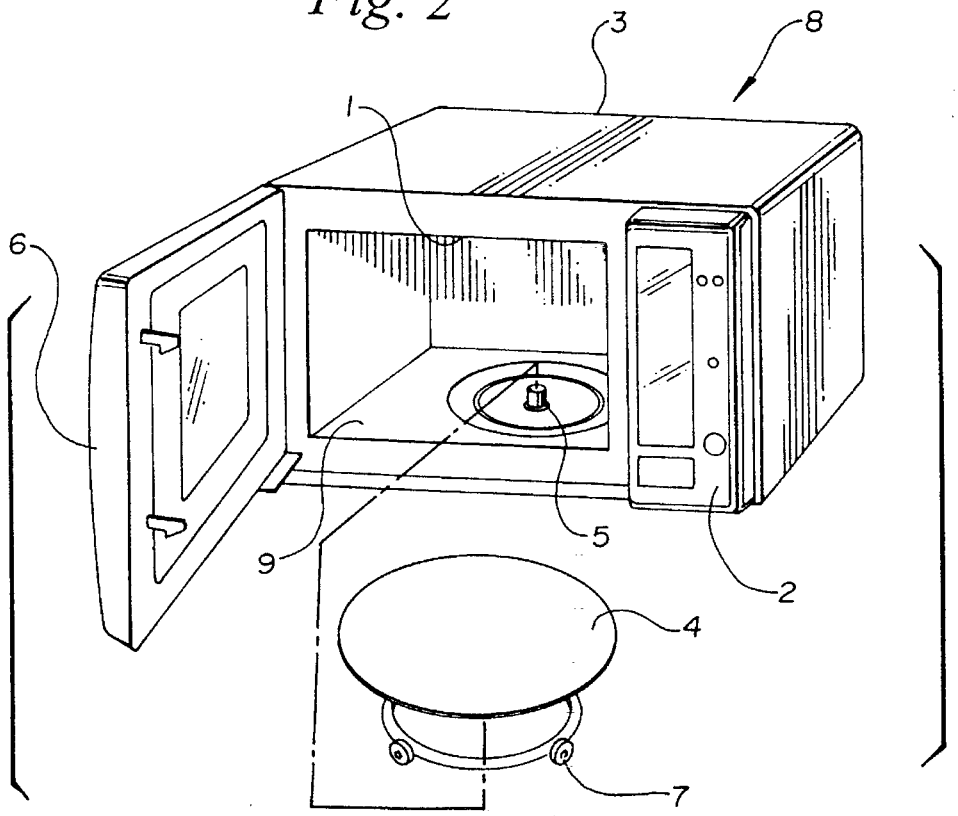
FIG. 2 is a perspective view of a microwave oven according to this invention.

Referring to FIG. 2, a microwave oven 8 according to this invention includes a heating chamber 1 having an open front side 9 and a hinged door 6 secured to the oven 8 over the open front side 9 for sealing the heating chamber 1. A rotating shaft 5 connected to a turntable driving motor (not shown) extends upwards from the bottom of the heating chamber 1. A tray 4 can be positioned on top of and engaged with the rotating shaft 5, and rollers 7 are positioned between the tray 4 and the bottom of the chamber 1 for assisting in tray rotation and balance. The tray 4 is adapted to hold and rotate food within the oven 8 during cooking. The oven 8 also comprises a magnetron (not shown) and a high voltage transformer (not shown) positioned outside of the heating chamber 1. It is to be understood that these elements need not differ from those found in the prior art.

A sensor (not shown) is positioned in the heating chamber 1 in a conventional manner. The sensor is used for remote sensing of the food temperature in the oven 8 by detecting the heat radiation emitted from the food, the wrap enclosing the food, or a container holding the food. The sensor used herein is preferably a thermopile type sensor or a bolometer type thermistor which utilizes the radiation heat absorption properties of a black body and a non-black body, such as that described in co-pending U.S. patent application entitled "Microwave Oven Employing Thermopile Type Sensor" and filed on Mar. 20, 1995, which is incorporated by reference herein.

Figure 3:
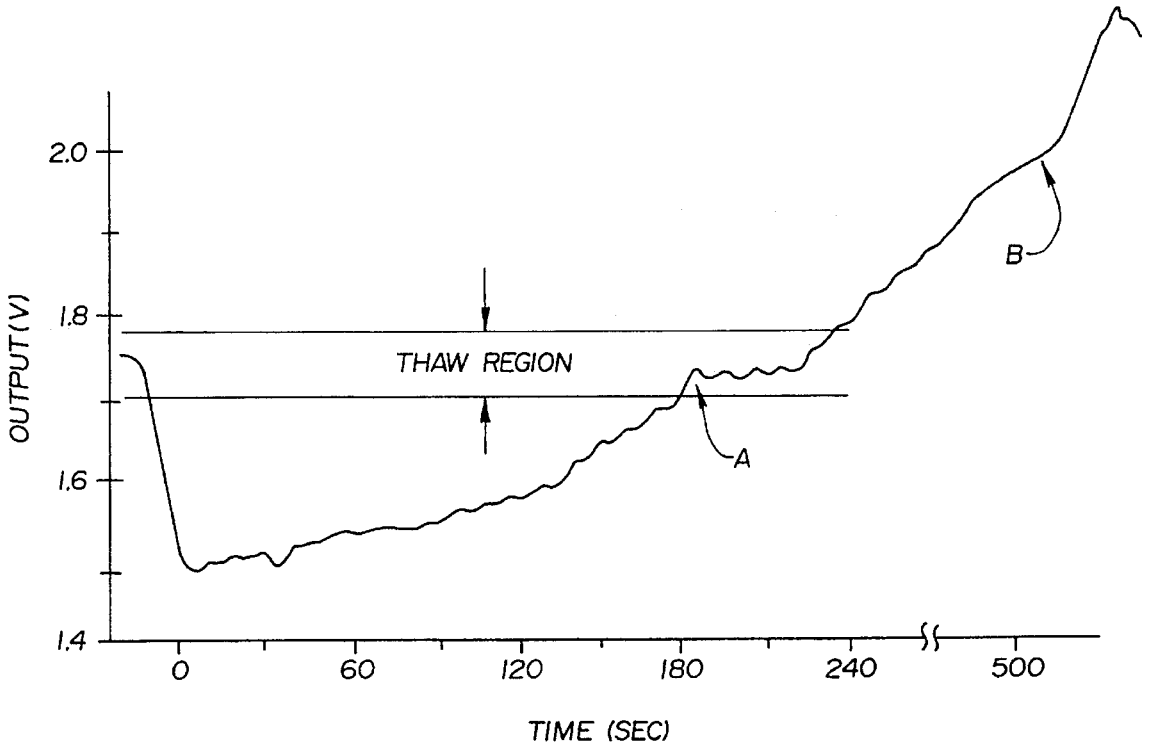
FIG. 3 is a sample wave pattern of the output voltage of a sensor of a microwave oven in accordance with this invention taken while cooking frozen meat.

FIG. 3 shows an example of the output voltage of a thermopile sensor used in this invention while heating 200 g of frozen meat for 20 minutes. As heating proceeds, the output voltage varies as is described herein. First, when a piece of frozen food (which definitionally has a temperature below 0° C.) is placed in the microwave oven 8, the output voltage of the sensor drops sharply, as can be seen by the drop in output voltage leading up to the time marked as 0. Such a phenomenon can be utilized as an automatic thawing recognition function.

Once the magnetron starts to operate (immediately following time 0), a water film begins to form on the surface of the food. This causes the surface temperature of the food to rise much faster than the interior temperature of the food. The rise in the surface temperature can be seen in FIG. 3 in the corresponding rise in the output voltage of the sensor.

In order to effectively thaw food, heat needs to be transferred from the exterior of the food to the interior of the food contemporaneously with the magnetron's continual heating of the exterior of the food. As can be seen in FIG. 3, the food is thawed when the output voltage of the sensor returns to the range of values centered around the value of the output voltage prior to the food being placed in the oven. Accordingly, an absolute value A, obtained through experimentation, can be selected as a reference point, i.e., as a thaw reference point for determining when cooking is completed. The thaw reference point A is corresponds to a surface temperature near 0° C., preferably about 5° C., and in the sample shown in FIG. 3 corresponds to a sensor output voltage of about 1.67 V.

When water starts to boil, normally as a result of continuous heating by the magnetron, the sensor's output voltage rises quickly due to rapid generation of vapor. A maximum rise point B, which can be determined through experimentation, corresponds to a point at which cooking should be terminated because when the output voltage reaches this level, water is surely boiling.

By monitoring the output voltage of the sensor and comparing it with the thaw reference point A and the maximum rise point B, the actual cooking time period can be properly controlled for thawing and warming up food. When thawing food, automatic cooking control can be effectuated by determining the thawing completion time period. This period is determined by multiplying the time period $T_1$ which it takes for the output voltage of the sensor to reach the thaw reference point A and the thawing cooking constant K. Similarly, when warming up food, the warming up completion time period is determined by multiplying the time period $T_1$ which it takes for the output voltage of the sensor to reach the thaw reference point A and the warming up cooking constant K. Finally, when the type of cooking requires fully boiling water, the automatic cooking control works by setting the reference detection point to be the maximum rise point B, determining the required cooking constant K, and multiplying this cooking constant K and the time period $T_1$ which it takes for the output voltage of the sensor to reach the maximum rise point B.

Accordingly, to operate the oven, a user presses a cooking selection button on the oven's 8 display panel 2 (see FIG. 2)

to select the type of cooking that is desired. The automatic program control then sets the reference detection point to be either the thaw reference point A or the maximum rise point B, according to the type of cooking selected by the user. Once the reference detection point has been set through the foregoing process, cooking begins. The time period that it takes for the output voltage of the sensor to reach the selected reference detection point is measured and defined to be time period $T_1$. Thereafter, a method similar to the control method that is used in the conventional art can be utilized.

The total cooking time period T is, as described previously in equation 4, $T=T_1+K\times T_1$. Thus, if the microwave oven is operated for an additional time period equivalent to the predetermined cooking constant K multiplied by the reference detection period $T_1$, which has just been determined, then full automatic cooking can be completed.

Figures 4, 4A:
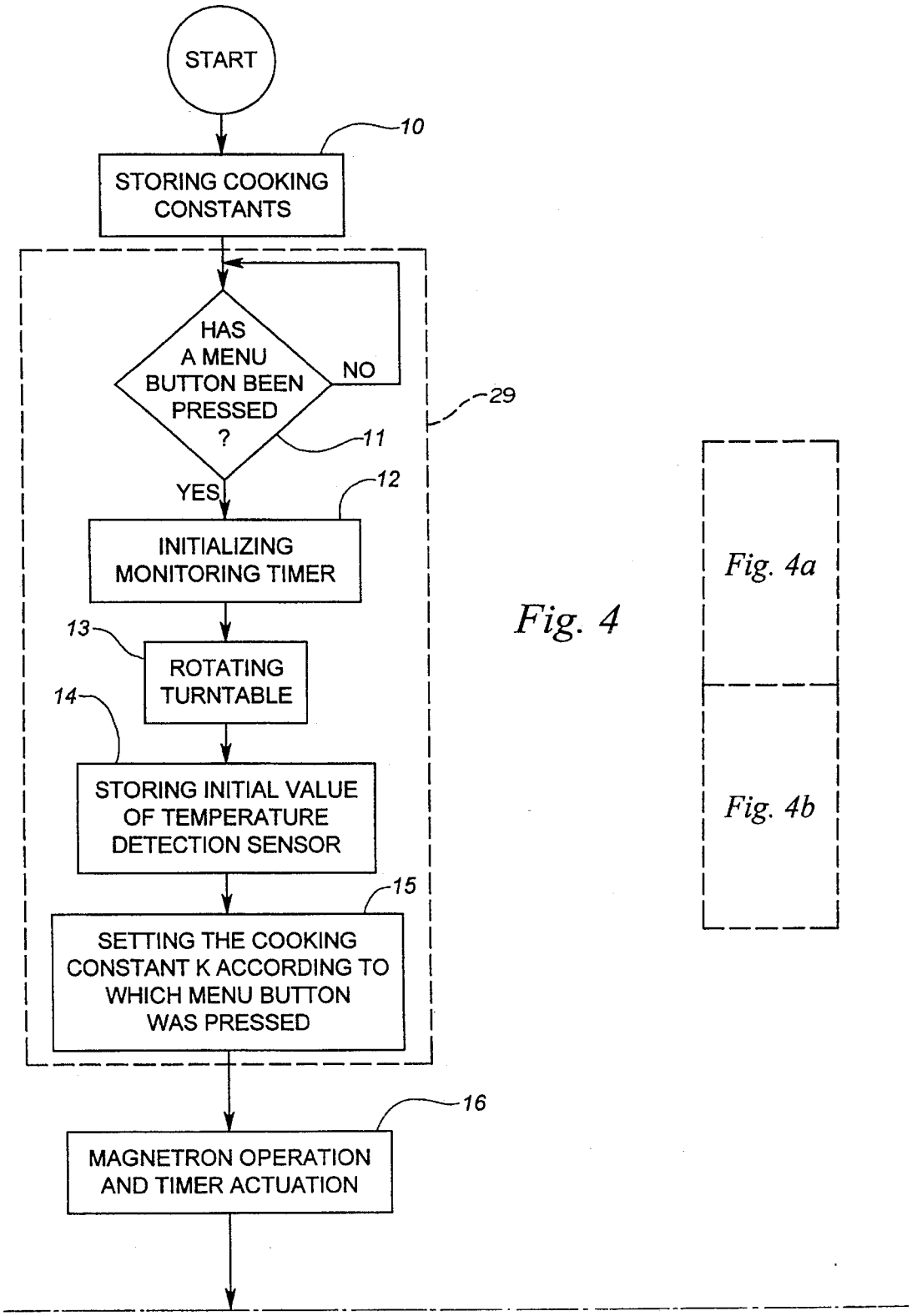
FIG. 4 is a flow chart of a method for automatic control of a microwave oven in accordance with this invention.

Referring now to FIG. 4, the flow chart therein describes the method for automatic cooking control by using the output voltage of a sensor in accordance with this invention. The first step is storing the cooking constants (step 10). This step preferably includes making an electronic table and storing various cooking constants K in the table. Separate cooking constants K for each type of cooking, such as warming up, thawing, scalding and smothering, should be stored. It is anticipated that this step will take place during the manufacture of microwave ovens which utilize the automatic cooking control method of this invention.

The next step is initializing the microwave oven (step 29), which includes the following steps. First it must be determined if any of the menu keys have been pressed, and wait until a menu key has been pressed (step 11). After a menu key has been pressed, a cooking time period monitoring timer, which is used for measuring the cooking time period, is initialized (step 12). The oven's turntable is rotated by controlling the driving motor (step 13). The initial output voltage value of the temperature detection sensor is stored (step 14), and the cooking constant K is selected from the previously stored values in the table (from step 10) according to the menu key that was pressed (step 15). For example, if the warming up menu button was pressed, the cooking constant K is set to correspond to warming up.

After initializing the microwave oven (step 29), the next step is magnetron operation (step 16), which includes operating the magnetron and the cooking time period monitoring timer. Following the magnetron operation (step 16), the cooking course is identified (step 17). This includes determining what type of cooking course was selected by the user (based on the menu button which was pressed in step 11), and whether it is desirable with that type of cooking for water to boil. For instance, in thawing and warming up, water boiling is not desired.

When water boiling is not desired, additional magnetron operation time period setting steps for the cooking course without water boiling are implemented (steps 18–22). These steps control magnetron operation for an initial period of time, and then set an additional time period for operating the magnetron. The initial period is $T_1$, and the additional period is $T_1\times K$, where $T_1$ corresponds to the time period that it takes for the output voltage of the temperature detection sensor to reach the thaw reference point A, and K is the predetermined cooking constant selected according to the desired type of cooking, as determined previously in step 15. The output voltage of the temperature detection sensor is detected and stored (step 18), and the detected output voltage is compared to the thaw reference point A (step 19). The magnetron continues to operate and steps 18–19 are repeated until the output voltage of the temperature detection sensor is greater than the thaw reference point A (step 20). As previously mentioned, the thaw reference point A preferably is predetermined to be the output voltage of the temperature detection sensor corresponding to a food surface temperature of about 5° C., which, according to experiments, corresponds to an output voltage of about 1.67 V for the preferred temperature detection sensor.

When the output voltage of the temperature detection sensor reaches the thaw reference point A, the amount of time that the magnetron has been operating (the initial period, $T_1$) is stored as the operation lapse time of the magnetron (step 21). The additional operation time period of the magnetron is determined based on the stored operation lapse time period of the magnetron, $T_1$, multiplied by the previously selected cooking constant K. This additional operation time period is then stored (step 22).

Alternatively, if the cooking program requires the boiling of water, such as scalding or smothering, then step 17 directs the automatic cooking control to implement magnetron operation steps 24–28 instead of steps 18–22. These steps include setting an initial operation time period and an additional operation time period of the magnetron based on the time period required for the output voltage of the temperature detection sensor to reach a maximum rise point B. This is done by using the maximum rise point B of the output voltage of the temperature detection sensor as the reference detection point and applying the same method as is used for cooking with water boiling. First, the output voltage of the temperature detection sensor is detected and stored (step 24), and the detected output voltage of the temperature detection sensor is compared to the maximum rise point B (step 25). The magnetron continues to operate and steps 24–25 are repeated until the output voltage of the temperature detection sensor is greater than the maximum rise point B, namely when the output voltage starts to rise rapidly (step 26).

When the output voltage of the temperature detection sensor has reached the maximum rise point B, the amount of time that the magnetron has been operating (the initial period, $T_1$) is stored as the operation lapse time of the magnetron (step 27). The additional operation time period of the magnetron is determined based on the stored operation lapse time period of the magnetron $T_1$, multiplied by the previously selected cooking constant K. This additional time period is then stored (step 28).

After setting the additional magnetron operation time period setting (step 22 or 28), the magnetron is operated for the additional operation time period (step 23).

As has been explained, this invention has the advantage of facilitating precise automatic cooking control even when selecting a type of cooking which is completed prior to water boiling, such as warming up or thawing. This is possible because the invention allows the setting of a reference detection point that is below the boiling point of water. This is accomplished using a temperature detection sensor and does not require any additional sensors, thus reducing manufacturing costs.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the claims.

What is claimed is:

1. A method for automatic control of a microwave oven having an automatic control unit with a memory and a cooking time period monitoring timer, a temperature detection sensor, a magnetron, and menu keys, comprising steps of:

storing in the memory cooking constants corresponding to different types of cooking;

initializing the microwave oven, including initializing the cooking time period monitoring timer;

storing an initial value of an output voltage of the temperature detection sensor corresponding to a measured temperature of a cooking object in the microwave oven;

selecting one of the cooking constants corresponding to a desired cooking type selected by a user actuating the menu keys;

operating the magnetron and starting the cooking time period monitoring timer for measuring an operating time period of the magnetron;

identifying whether the desired cooking type is one in which water boiling is desired;

setting a first cooking time period for a cooking course without water boiling based on a time period which it takes for the output voltage of the temperature detection sensor to reach a thaw reference point or for a cooking course with water boiling based on a time period which it takes for the output voltage of the temperature detection sensor to reach a maximum rise point;

setting a total cooking time period based on the sum of the first cooking time period and the product of the first cooking time period and the selected cooking constant; and continuing operation of the magnetron until it has been operating for the total cooking time period.

2. The method of claim 1, wherein the step of setting a first cooking time period for a cooking course without water boiling includes:

setting the thaw reference point to a predetermined value stored in the memory of the microwave oven at the time of manufacture;

detecting and storing the output voltage of the temperature detection sensor;

comparing the detected output voltage of the temperature detection sensor to the thaw reference point;

repeating the steps of detecting the output voltage and comparing the output voltage until the output voltage of the temperature detection sensor reaches the thaw reference point; and detecting and storing as the first cooking time period an operation lapse time of the magnetron corresponding to a time period which it took for the output voltage of the temperature detection sensor to reach the thaw reference point.

3. The method of claim 1, wherein the step of setting a first cooking time period for a cooking course with water boiling includes:

detecting and storing the output voltage of the temperature detection sensor;

comparing the detected output voltage of the temperature detection sensor to a stored previous output voltage of the temperature detection sensor;

repeating the steps of detecting the output voltage and comparing the output voltage until the output voltage of the temperature detection sensor reaches the maximum rise point; and detecting and storing as the first cooking time period an operation lapse time of the magnetron corresponding to a time period which it took for the output voltage of the temperature detection sensor to reach the maximum rise point.

4. The method of claim 1, wherein the thaw reference point is determined by monitoring the output voltage of the temperature detection sensor to measure when the cooking object temperature starts to rise rapidly.

5. The method of claim 1 wherein the maximum rise point is determined by monitoring the output voltage of the temperature detection sensor to measure when the temperature of the cooking object reaches a maximum point and starts to decrease.

* * * * *